US010792217B2

(12) United States Patent
Liang

(10) Patent No.: US 10,792,217 B2
(45) Date of Patent: Oct. 6, 2020

(54) COLD-HOT MIXED TYPE HUMIDIFYING FACIAL STEAMER

(71) Applicant: Jingqing Liang, Zhongshan (CN)

(72) Inventor: Jingqing Liang, Zhongshan (CN)

( * ) Notice: Subject to any disclaimer, the term of this patent is extended or adjusted under 35 U.S.C. 154(b) by 164 days.

(21) Appl. No.: 16/042,574

(22) Filed: Jul. 23, 2018

(65) Prior Publication Data

US 2019/0029921 A1 Jan. 31, 2019

(30) Foreign Application Priority Data

Jul. 25, 2017 (CN) ..... 2017 1 0612598

(51) Int. Cl.
*A61H 33/12* (2006.01)
*A61H 33/06* (2006.01)

(52) U.S. Cl.
CPC ..... *A61H 33/12* (2013.01); *A61H 33/065* (2013.01)

(58) Field of Classification Search
CPC ..... A61H 33/12; A61H 33/065; A61M 35/00
See application file for complete search history.

(56) References Cited

U.S. PATENT DOCUMENTS 4,399,349 A * 8/1983 Deming ..... A45D 19/16 128/203.17
2005/0061896 A1* 3/2005 Luettgen ..... B05B 1/1654 239/449
2005/0287007 A1* 12/2005 Leonhard ..... F04B 53/003 417/11
2010/0219180 A1* 9/2010 Bamen ..... A61H 33/065 219/628
2013/0097773 A1* 4/2013 Pinkus ..... A61H 33/065 4/524
2013/0160760 A1* 6/2013 Chen ..... A61H 33/12 128/200.19

FOREIGN PATENT DOCUMENTS

JP 2008295467 A * 12/2008

* cited by examiner

*Primary Examiner* — Gary Johnson
*Assistant Examiner* — Sebastian X Lukjan

(57) ABSTRACT

A cold-hot mixed type humidifying facial steamer comprising a shell, wherein a water tank assembly is arranged on one side of the inner chamber of the shell, and a fan is arranged on the other side of the inner chamber of the shell; a cold humidifying mist chamber is arranged below the water tank assembly; the cold humidifying mist chamber is connected with a hot humidifying steam chamber through a water pipe; an atomizer is arranged underneath the cold humidifying mist chamber; the top of the cold humidifying mist chamber is connected with one side of the bottom of an herb feeding chamber through a cold mist conveying pipe; a heating element is arranged in the hot humidifying steam chamber; the hot humidifying steam chamber is connected with the other side of the bottom of the herb feeding chamber through a hot steam conveying pipe.

8 Claims, 4 Drawing Sheets

COLD-HOT MIXED TYPE HUMIDIFYING FACIAL STEAMER

TECHNICAL FIELD OF THE INVENTION

The present invention relates to the technical field of living goods, and more particularly, to a cold-hot mixed type humidifying facial steamer.

BACKGROUND OF THE INVENTION

A facial steamer is a modern at-home beauty care appliance. Its basic principle is to convert water into nanoscale steam particles having a higher temperature through high-tech means. It opens up the pores to deeply hydrate and gradually rejuvenate the skin. Therefore, skin's moisture level and elasticity can be increased, blood circulation can be promoted, and wrinkle depth can be reduced. In the prior art, most of the traditional facial steamers are designed to merely accomplish a single function. Even worse, skin problems such as rough pores can be caused after prolonged use. Thus, it's urgent for those skilled in this field to develop a novel facial steamer.

SUMMARY OF THE INVENTION

The purpose of the present invention is to solve the shortcomings in the prior art by providing a cold-hot mixed type humidifying facial steamer, which has a reasonable structure and a high reliability.

To achieve the above purpose, the present invention adopts the following technical solution:

A cold-hot mixed type humidifying facial steamer comprising a shell, wherein a water tank assembly is arranged on one side of the inner chamber of the shell, and a fan is arranged on the other side of the inner chamber of the shell; a cold humidifying mist chamber is arranged below the water tank assembly; the cold humidifying mist chamber is connected with a hot humidifying steam chamber through a water pipe; an atomizer is arranged underneath the cold humidifying mist chamber; the top of the cold humidifying mist chamber is connected with one side of the bottom of an herb feeding chamber through a cold mist conveying pipe; a heating element is arranged in the hot humidifying steam chamber; the hot humidifying steam chamber is connected with the other side of the bottom of the herb feeding chamber through a hot steam conveying pipe; a porous herb bag mounting base is arranged in the herb feeding chamber; a delivering pipe is arranged at the top of the herb feeding chamber, and a flange plate is formed at the top end surface of the delivering pipe; the top of the flange plate is connected with a first venting plate and a second venting plate that interact with each other; a sliding rail is arranged on the periphery of the first venting plate; a plurality of sliding blocks is arranged on the second venting plate; the first venting plate and the second venting plate can rotate relative to each other through the interaction of the sliding blocks and the sliding rail; a plurality of venting holes is formed in both the first venting plate and the second venting plate.

In another aspect of the present invention, a drain pipe is arranged at the bottom of the hot humidifying steam chamber, and a rubber stopper is arranged at the bottom of the drain pipe.

In another aspect of the present invention, a damping support is arranged at the bottom of the shell, and a damping spring device is arranged on the damping support.

In another aspect of the present invention, the venting holes in the first venting plate are arranged to correspond to the venting holes in the second venting plate, and the diameter of the venting holes in the first venting plate is the same as that of the venting holes in the second venting plate. The sliding blocks are fixedly connected to the periphery of the bottom of the second venting plate, and the number of the sliding blocks is four.

In another aspect of the present invention, the heating element is an electric heater, which is capable of adjusting the temperature according to a user's need.

In another aspect of the present invention, the first venting plate and the second venting plate are round-shaped.

In another aspect of the present invention, a power cord is arranged on the outer side of the shell, and the power cord is electrically connected with the fan, the atomizer and the heating element.

In another aspect of the present invention, the facial steamer is provided with a face cleaning device. One side of the shell is arranged in a receiving groove used for receiving the face cleaning device. The bottom of the face cleaning device is rotatably installed in the receiving groove through a rotating shaft. The face cleaning device comprises a rod body, a rotating table and a face cleaning sponge. A rotating motor is arranged in the rod body, and a center-controlled shaft body is arranged on the lower surface of the rotating table. A gear ring is fixedly arranged on the shaft body, and a gear meshed with the gear ring is arranged in the rod body. The gear is driven by the rotating motor fixed on the inner wall of the rod body, and a fixing groove is formed in the rotating table. The face cleaning sponge is fixed in the fixing groove.

In another aspect of the present invention, a face cleaning water pipe is arranged in the rod body. One end of the face cleaning water pipe is connected with the cold mist conveying pipe through a connecting pipe, and the other end of the face cleaning water pipe is connected to a water storage chamber on the rotating table. A plurality of water seepage holes that are communicated with the fixing groove is uniformly distributed in the upper surface of the water storage chamber. A micro water pump is arranged on the connecting pipe, and a water pump control switch is arranged on the rod body.

Compared with the prior art, the present invention has the following advantages:

The first venting plate is connected with the second venting plate through the sliding rail and sliding blocks, enabling the cold mist and hot steam to be evenly sprayed onto a user's face. Through regulating the relative positions of the venting holes in the first venting plate and the second venting plate, the output of the cold mist and hot steam can be controlled, achieving the purpose of steaming one's face with both cold mist and hot steam. Furthermore, through the porous herb bag mounting base arranged in the herb feeding chamber, the cold mist and hot steam and penetrate through the herb bag placed on the porous herb bag mounting base. As a result, the herbal ingredients in the herb bag are conveyed to the first venting plate and the second venting plate along the cold mist and hot steam, and are further sprayed onto a user's face. Thus, an herbal steam treatment can be achieved.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

Shell 1, Water Tank Assembly 2, Fan 3, Cold Humidifying Mist Chamber 4, Water Pipe 5, Hot Humidifying Steam Chamber 6, Atomizer 7, Cold Mist Conveying Pipe 8, Herb Feeding Chamber 9, Heating Element 10, Hot Steam Conveying Pipe 11, Porous Herb Bag Mounting Base 12, Delivering Pipe 13, Flange plate 14, The First Venting Plate 15, Sliding Rail 16, Sliding Block 17, The Second Venting Plate 18, Venting Hole 19, Drain Pipe 20, Rubber Stopper 21, Damping Support 22, Damping Spring Device 23, Power Cord 24, Face Cleaning Device 31, Receiving Groove 32, Rod Body 321, Rotating Table 322, Face Cleaning Sponge 323, Rotating Motor 324, Shaft Body 325, Fixing Groove 326, Face Cleaning Water Pipe 327, Connecting Pipe 328, Water Storage Chamber 329, Water Seepage Hole 330, Micro Water Pump 331, Water Pump Control Switch 332, Gear 333, Gear Ring 344

DETAILED DESCRIPTION OF THE INVENTION

Drawings and detailed embodiments are combined hereinafter to elaborate the technical principles of the present invention.

Figure 1:
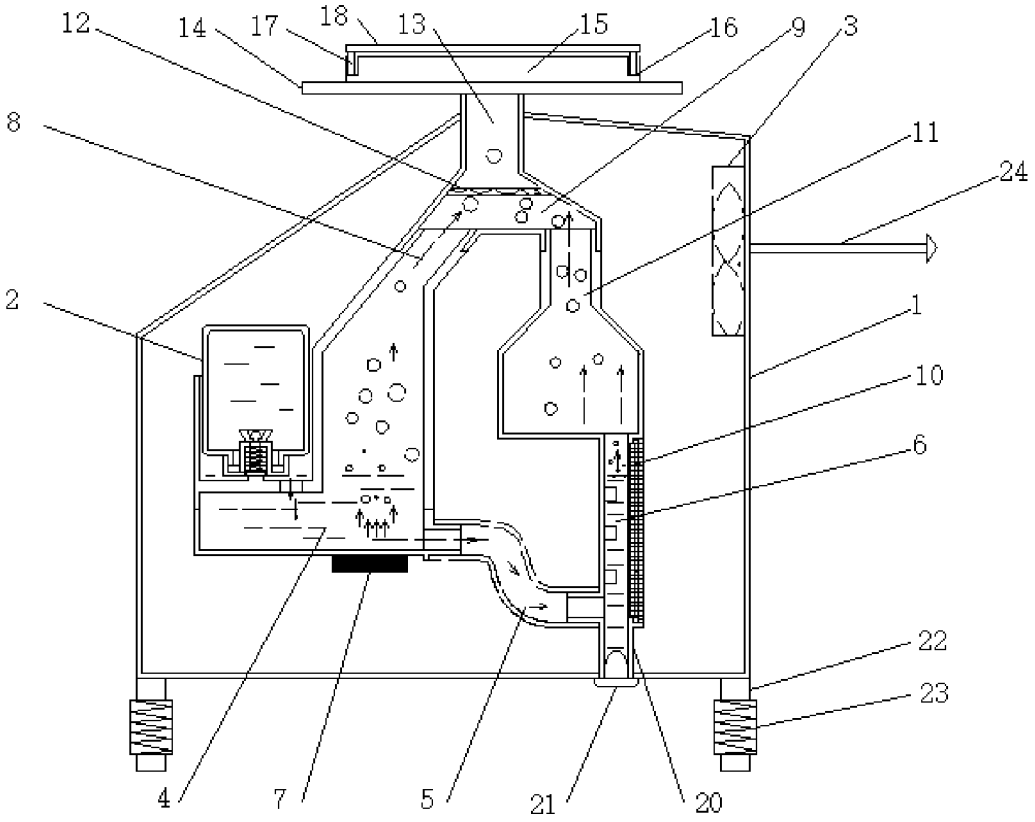
FIG. 1 is a sectional view of the present invention.
Figure 2:
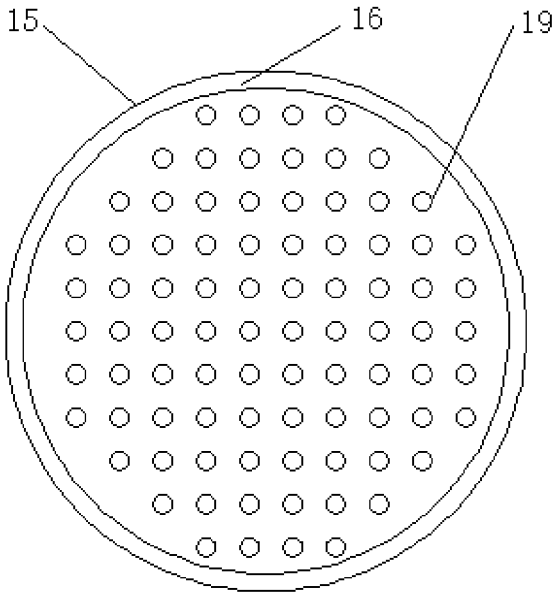
FIG. 2 is a top view of the first venting plate of the present invention.
Figure 3:
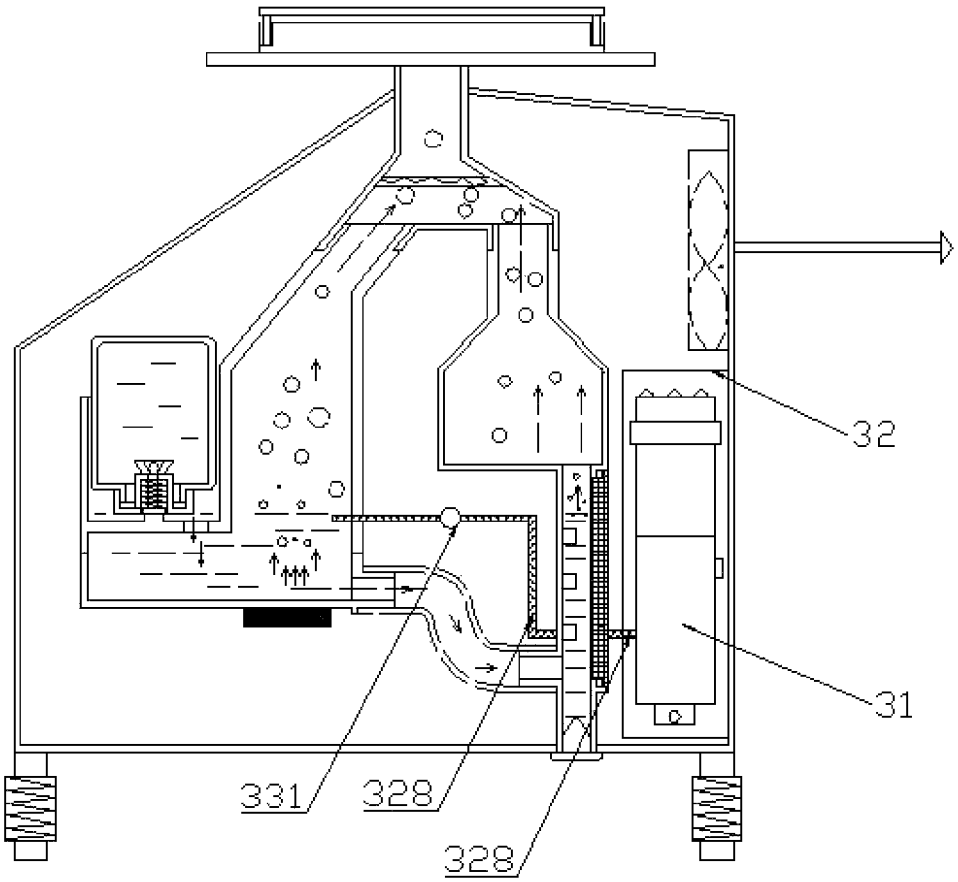
FIG. 3 is a structural diagram of the facial steamer with a face cleaning device of the present invention.
Figure 4:
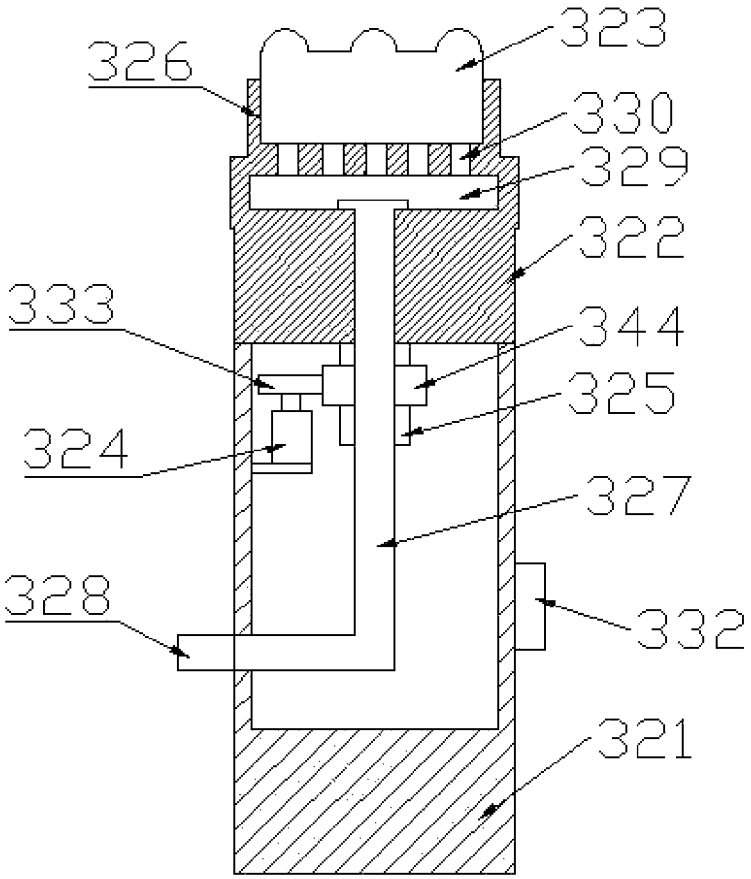
FIG. 4 is a structural diagram of the face cleaning device.

As shown in FIGS. 1-2, the cold-hot mixed type humidifying facial steamer comprising a shell 1, wherein a water tank assembly 2 is arranged on one side of the inner chamber of the shell 1 for serving as a storage place of the water source. A fan 3 is arranged on the other side of the inner chamber of the shell 1 for facilitating the spray of the mist and steam. A cold humidifying mist chamber 4 is arranged below the water tank assembly 2, which is capable of generating the cold mist. The cold humidifying mist chamber 4 is connected with a hot humidifying steam chamber 6 through a water pipe 5, which serves as a conveying channel of the water source. An atomizer 7 is arranged underneath the cold humidifying mist chamber 4 for turning the water into a fine mist. The top of the cold humidifying mist chamber 4 is connected with one side of the bottom of an herb feeding chamber 9 through a cold mist conveying pipe 8. A heating element 10 is arranged in the hot humidifying steam chamber 6, thereby heating the water to generate steam. The hot humidifying steam chamber 6 is connected with the other side of the bottom of the herb feeding chamber 9 through a hot steam conveying pipe 11. A porous herb bag mounting base 12 is arranged in the herb feeding chamber 9 for receiving the herb bag. Thus, an herbal steam treatment can be achieved. A delivering pipe 13 is arranged at the top of the herb feeding chamber 9, and a flange plate 14 is formed at the top end surface of the delivering pipe 13. The top of the flange plate 14 is connected with a first venting plate 15 and a second venting plate 18 that interact with each other to serve as the outlets of the cold mist and the hot steam. A sliding rail 16 is arranged on the periphery of the first venting plate 15, which allows sliding blocks 17 to slide thereon. A plurality of sliding blocks 17 is arranged on the second venting plate 18. The first venting plate 15 and the second venting plate 18 can rotate relative to each other through the interaction of the sliding blocks 17 and the sliding rail 16. A plurality of venting holes 19 is formed in both the first venting plate 15 and the second venting plate 19, enabling the cold mist and the hot steam to be sprayed out to a user's face.

A drain pipe 20 is arranged at the bottom of the hot humidifying steam chamber 6, and a rubber stopper 21 is arranged at the bottom of the drain pipe 20. The facial steamer of the present invention utilizes constant air pressure to keep the water level of the two sides while adjusting the water level difference. During the operating process, the drain pipe 20 is stopped by the rubber stopper 21. A damping support 22 is arranged at the bottom of the shell 1, and a damping spring device 23 is arranged on the damping support 22, thereby achieving an ideal damping effect of the shell 1. The venting holes 19 in the first venting plate 15 are arranged to correspond to the venting holes 19 in the second venting plate 18, and the diameter of the venting holes 19 in the first venting plate 15 is same as that of the venting holes 19 in the second venting plate 18. The sliding blocks 17 are fixedly connected to the periphery of the bottom of the second venting plate 18, and the number of the sliding blocks 17 is four. The sliding blocks 17 is capable of adjusting the relative positions of the venting holes in the first venting plate and the second venting plate, thereby controlling the output of the cold mist and the hot steam. The heating element 10 is an electric heater. The first venting plate 15 and the second venting plate 18 are round-shaped, and are made of stainless steel. A power cord 24 is arranged on the outer side of the shell 1. The power cord 24 is electrically connected with the fan 3, the atomizer 7 and the heating element 10 for supplying power to them.

When using the facial steamer of the present invention, the water in the water tank assembly 2 is conveyed to the cold humidifying mist chamber 4, and is turned into a cold mist under the action of the atomizer 7. The cost mist is further conveyed to the herb feeding chamber 9 through the cold mist conveying pipe 8 under the action of the fan 3. Meanwhile, the water in the cold humidifying mist chamber 4 enters into the hot humidifying steam chamber 6 through the water pipe 5. The water is heated by the heating element 10 to generate hot steam. By means of the fan 3, the hot steam is conveyed to the herb feeding chamber 9 through the hot steam conveying pipe 11. After passing through the porous herb bag mounting base 12, the hot steam enters into the delivering pipe 13. At the moment, the second venting plate 18 is rotated to enable the sliding blocks 17 to slide on the sliding rail 16. Thus, relative positions of the venting holes 19 in the first venting plate 15 and the second venting plate 18 can be adjusted, and the output of the cold mist and hot steam can be controlled.

Furthermore, the facial steamer of the present invention is provided with a face cleaning device 31. One side of the shell 1 is arranged in a receiving groove 32 used for receiving the face cleaning device 31. The bottom of the face cleaning device 31 is rotatably installed in the receiving groove 32 through a rotating shaft. The face cleaning device comprises a rod body 321, a rotating table 322 and a face cleaning sponge 323. A rotating motor 324 is arranged in the rod body 321, and a center-controlled shaft body 325 is arranged on the lower surface of the rotating table 322. A gear ring 344 is fixedly arranged on the shaft body 325, and a gear 333 meshed with the gear ring 344 is arranged in the rod body 321. The gear 333 is driven by the rotating motor

324 fixed on the inner wall of the rod body 321, and a fixing groove 326 is formed in the rotating table 322. The face cleaning sponge 323 is fixed in the fixing groove 326.

A face cleaning water pipe 327 is arranged in the rod body 321. One end of the face cleaning water pipe 327 is connected with the cold mist conveying pipe 8 through a connecting pipe 328, and the other end of the face cleaning water pipe 327 is connected to a water storage chamber 329 on the rotating table 322. A plurality of water seepage holes 330 that are communicated with the fixing groove 326 is uniformly distributed in the upper surface of the water storage chamber 329. A micro water pump 331 is arranged on the connecting pipe 328, and a water pump control switch 332 is arranged on the rod body 321.

Before cleaning the face, the face cleaning device can be rotated out from the receiving groove. After a facial cleanser is squeezed onto the face cleaning sponge 323, the water pump can be controlled through the water pump control switch 332 to moisturize the face cleaning sponge 323. Subsequently, the rotating motor is initiated, and the face cleaning sponge 323 is attached to the user's face. The face cleaning sponge 323 rotates along the rotating table, thereby automatically cleansing the user's face.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A cold-hot mixed type humidifying facial steamer, comprising:

a shell, wherein a water tank assembly is arranged on one side of an inner chamber of the shell, wherein a fan is arranged on the other side of the inner chamber of the shell, wherein a cold humidifying mist chamber is arranged below the water tank assembly, wherein the cold humidifying mist chamber is connected with a hot humidifying steam chamber through a water pipe, wherein an atomizer is arranged underneath the cold humidifying mist chamber, wherein the top of the cold humidifying mist chamber is connected with one side of the bottom of an herb feeding chamber through a cold mist conveying pipe, wherein a heating element is arranged in the hot humidifying steam chamber, wherein the hot humidifying steam chamber is connected with the other side of the bottom of the herb feeding chamber through a hot steam conveying pipe, wherein a porous herb bag mounting base is arranged in the herb feeding chamber, wherein a delivering pipe is arranged at the top of the herb feeding chamber, wherein a flange plate is formed at the top end surface of the delivering pipe, wherein the top of the flange plate is connected with a first venting plate and a second venting plate that interact with each other, wherein a sliding rail is arranged on the periphery of the first venting plate, wherein a plurality of sliding blocks is arranged on the second venting plate, wherein the first venting plate and the second venting plate can rotate relative to each other through the interaction of the sliding blocks and the sliding rail, wherein a plurality of venting holes is formed in both the first venting plate and the second venting plate; wherein the facial steamer is provided with a face cleaning device, wherein one side of the shell is arranged in a receiving groove used for receiving the face cleaning device, wherein the bottom of the face cleaning device is rotatably installed in the receiving groove through a rotating shaft, wherein the face cleaning device comprises a rod body, a rotating table and a face cleaning sponge, wherein a rotating motor is arranged in the rod body, and a center-controlled shaft body is arranged on the lower surface of the rotating table, wherein a gear ring is fixedly arranged on the shaft body, wherein a gear meshed with the gear ring is arranged in the rod body, wherein the gear is driven by the rotating motor fixed on the inner wall of the rod body, and a fixing groove is formed in the rotating table, wherein the face cleaning sponge is fixed in the fixing groove.

2. The cold-hot mixed type humidifying facial steamer of claim 1, wherein a drain pipe is arranged at the bottom of the hot humidifying steam chamber, and a rubber stopper is arranged at the bottom of the drain pipe.

3. The cold-hot mixed type humidifying facial steamer of claim 1, wherein a damping support is arranged at the bottom of the shell, and a damping spring device is arranged on the damping support.

4. The cold-hot mixed type humidifying facial steamer of claim 1, wherein the venting holes in the first venting plate are arranged to correspond to the venting holes in the second venting plate, and the diameter of the venting holes in the first venting plate is same as that of the venting holes in the second venting plate, wherein the sliding blocks are fixedly connected to the periphery of the bottom of the second venting plate, and the number of the sliding blocks is four.

5. The cold-hot mixed type humidifying facial steamer of claim 1, wherein the heating element is an electric heater.

6. The cold-hot mixed type humidifying facial steamer of claim 1, wherein the first venting plate and the second venting plate are round-shaped.

7. The cold-hot mixed type humidifying facial steamer of claim 1, wherein a power cord is arranged on the outer side of the shell, and the power cord is electrically connected with the fan, the atomizer and the heating element.

8. The cold-hot mixed type humidifying facial steamer of claim 1, wherein a face cleaning water pipe is arranged in the rod body, wherein one end of the face cleaning water pipe is connected with the cold mist conveying pipe through a connecting pipe, and the other end of the face cleaning water pipe is connected to a water storage chamber on the rotating table, wherein a plurality of water seepage holes that are communicated with the fixing groove is uniformly distributed in the upper surface of the water storage chamber, wherein a micro water pump is arranged on the connecting pipe, and a water pump control switch is arranged on the rod body.

* * * * *